US007404485B2

(12) United States Patent
Uitenbroek

(10) Patent No.: US 7,404,485 B2
(45) Date of Patent: Jul. 29, 2008

(54) PAPER ROLL WRAP, WRAPPED PAPER ROLL, AND METHOD FOR WRAPPING A PAPER ROLL

(76) Inventor: David Uitenbroek, 1277 St. Patrick Way, Sun Prairie, WI (US) 53590

( * ) Notice: Subject to any disclaimer, the term of this patent is extended or adjusted under 35 U.S.C. 154(b) by 0 days.

(21) Appl. No.: 11/440,785

(22) Filed: May 24, 2006

(65) Prior Publication Data

US 2007/0272574 A1 Nov. 29, 2007

(51) Int. Cl.
*B65D 85/00* (2006.01)

(52) U.S. Cl. ..... 206/410; 206/407; 206/413; 206/416

(58) Field of Classification Search ..... 206/410, 206/407, 413, 389, 414, 415, 416
See application file for complete search history.

(56) References Cited

U.S. PATENT DOCUMENTS

| | | | | |
|---|---|---|---|---|
| 3,844,718 | A | 10/1974 | Cohen | |
| 4,049,121 | A | 9/1977 | White | |
| 4,303,462 | A | 12/1981 | Karr | |
| 4,651,500 | A | 3/1987 | Chaffey | |
| 4,820,374 | A | 4/1989 | Lamb | |
| 4,858,762 | A * | 8/1989 | Kewin | 206/414 |
| 4,860,893 | A | 8/1989 | Kaufman | |
| 4,909,179 | A | 3/1990 | McBride | |
| 5,090,566 | A | 2/1992 | Yount | |
| 5,167,322 | A | 12/1992 | Lemaire | |
| 5,238,736 | A | 8/1993 | Tseng et al. | |
| 5,366,085 | A | 11/1994 | Kewin | |
| 5,392,585 | A | 2/1995 | Wall | |
| 5,572,848 | A | 11/1996 | Wall | |
| 5,642,600 | A | 7/1997 | Hooper et al. | |
| 5,761,881 | A | 6/1998 | Wall | |
| 5,960,608 | A | 10/1999 | Ohtonen | |
| 6,186,326 | B1 | 2/2001 | Pienta et al. | |
| 6,347,498 | B1 | 2/2002 | Pienta et al. | |

(Continued)

OTHER PUBLICATIONS

Wrappers from web site http://www.cascades-sonoco.com/english/02_products/02_03.htm.

(Continued)

*Primary Examiner*—David T Fidei
(74) *Attorney, Agent, or Firm*—Merchant & Gould, P.A.

(57) ABSTRACT

A roll wrap for wrapping a paper roll is provided. The roll wrap includes an outer wrapper and a header. The outer wrapper is constructed for circumscribing the periphery of the paper roll long a length of the paper roll from a first end of the paper roll to a second end of the paper roll. The outer wrapper includes a peripheral wrapper portion, a first edge region for forming a first crimp, a second edge region for forming a second crimp, an interior surface for contacting the paper roll, and an exterior surface. At least one of the exterior surface first edge region and the exterior surface second edge region or the interior surface first edge region and the interior surface second edge region includes a self seal adhesive. The header includes a first surface and a second surface. At least one of the first header first surface and the header second surface includes a self seal adhesive. A wrapped paper roll and a method for wrapping a paper roll are provided.

17 Claims, 4 Drawing Sheets

U.S. PATENT DOCUMENTS

| | | | | |
|---|---|---|---|---|
| 6,378,454 | B1 | 4/2002 | Massi | |
| 6,505,459 | B1 | 1/2003 | Ruohio et al. | |
| 6,774,063 | B2 | 8/2004 | Bouchette et al. | |
| 6,830,645 | B2 | 12/2004 | Wells et al. | |
| 6,938,549 | B2 | 9/2005 | Bullock | |
| 2002/0033350 | A1 * | 3/2002 | Itkonen et al. | 206/410 |
| 2002/0192406 | A1 | 12/2002 | Labbe et al. | |
| 2005/0004259 | A1 | 1/2005 | Freyberg et al. | |
| 2005/0153085 | A1 | 7/2005 | Drummond | |
| 2005/0252952 | A1 | 11/2005 | Nomula | |
| 2005/0258219 | A1 | 11/2005 | Languillat et al. | |
| 2005/0260365 | A1 | 11/2005 | Nin et al. | |
| 2006/0277866 | A1 * | 12/2006 | Bowden et al. | 53/210 |

OTHER PUBLICATIONS

Outside Headers from web site http://www.cascades-sonoco.com/english/02_products/02_02.htm.

Inside Headers from web site http://www.cascades-sonoco.com/english/02_products/02_01.htm.

Sellocoat from web site http://www.cascades-sonoco.com/english/02_products/02_04.htm.

Ream Wrap from web site http://www.cascades-sonoco.com/english/02_products/02_05.htm.

Heat Platens from web site http://www.cascades-sonoco.com/english/02_products/02_06.htm.

* cited by examiner

PAPER ROLL WRAP, WRAPPED PAPER ROLL, AND METHOD FOR WRAPPING A PAPER ROLL

FIELD OF THE INVENTION

The present invention relates to a paper roll wrap, to a wrapped paper roll, and to a method for wrapping a paper roll. The roll wrap utilizes a self seal adhesive to provide a paper roll wrap that protects a paper roll from moisture and mechanical impacts.

BACKGROUND OF THE INVENTION

Paper rolls which are produced by the paper making industry are usually stored and shipped standing on end. The paper rolls may be about 1 foot to about 11 feet in width and may have diameters of about 2 feet to about 6 feet. In order to protect the paper rolls during storage and shipment, the paper rolls are commonly packaged using roll wrap. In general, roll wrap includes a wrapper that circumscribes the paper roll, and is crimped about the outer peripheral edge portions of the paper roll. Headers can be applied to the ends of the paper roll to protect the paper roll from moisture and mechanical impacts, and to facilitate automated handling without risk of damaging the paper roll.

Paper roll wraps are commonly available having hot melt adhesive provided along the portion of the roll wrap where it is desirable to provide adhesive bonding. Hot melt adhesive is commonly provided on the header to help seal the roll wrap to protect the paper roll from moisture and mechanical impacts. The header commonly includes an inside header and an outside header. The inside header can be provided abutting the end of the paper roll with the wrapper crimped thereover. The outside header can include the hot melt adhesive for sealing to the inside header and to the crimped wrapper end. Accordingly, the inside header helps protect the roll of paper from the hot melt adhesive on the outside header. Heated platens are often used to apply the outside header. An exemplary patent that describes the use of a hot melt adhesive for applying an outside header includes U.S. Pat. No. 6,505,459 to Ruohio et al.

The roll wrap can rely upon the presence of a thermoplastic polymer coating for providing a heat seal. Exemplary thermoplastics that can be used to provide a heat seal include polyethylene, polypropylene, and polyvinyl. Exemplary patents describing the use of thermoplastics for heat seal include U.S. Pat. No. 5,090,566 to Yount and U.S. Pat. No. 4,820,374 to Lamb.

Various equipment designs are available for wrapping paper rolls. See U.S. Pat. No. 6,505,459 to Ruohio et al., U.S. Pat. No. 5,642,600 to Hooper et al., U.S. Pat. No. 4,303,462 to Karr, and U.S. Pat. No. 5,960,608 to Ohtonen.

SUMMARY OF THE INVENTION

A roll wrap for wrapping a paper roll is provided according to the invention. The roll wrap includes an outer wrapper and a header. The outer wrapper is constructed for circumscribing the periphery of the paper roll long a width of the paper roll from a first end of the paper roll to a second end of the paper roll. The outer wrapper includes a peripheral wrapper portion, a first edge region for forming a first crimp, a second edge region for forming a second crimp, an interior surface for contacting the paper roll, and an exterior surface. At least one of the exterior surface first edge region and the exterior surface second edge region or the interior surface first edge region and the interior surface second edge region includes a self seal adhesive. The header includes a first surface and a second surface. At least one of the header first surface and the header second surface includes a self seal adhesive. The self seal adhesive on the outer wrapper and the self seal adhesive on the header are available for bonding together.

A wrapped paper roll is provided according to invention. The paper roll can be provided having a width about 1 foot to about 11 feet from a first end of the paper roll to a second end of paper roll. A roll wrap can be provided packaging the paper roll and providing protection to the paper roll from moisture and mechanical impacts. The roll wrap can include an outer wrapper circumscribing the periphery of the paper roll along the length of the paper roll from the first end to the second end, and a header provided at the first end and the second end of the paper roll. The outer wrapper can include a peripheral wrapper portion, a first edge region forming a first crimped edge over the first end of the paper roll, a second edge region forming a second crimped edge over the second end of the paper roll, an interior surface for contacting the paper roll, and an exterior surface. At least one of the exterior surface first edge region and the exterior surface second edge region or the interior surface first edge region and the interior surface second edge region includes a self seal adhesive. The header includes a first surface and a second surface wherein at least one of the first surface and the second surface includes a self seal adhesive. The self seal adhesive on the outer wrapper and the self seal adhesive on the header are available for bonding together.

A method for wrapping a roll of paper is provided according to the invention. The method includes a step of wrapping an outer wrapper about a roll of paper, placing an inside header at the paper roll first end and at the paper roll second end, crimping the outer wrapper to form a first crimp at the paper first end and a second crimp at the paper roll second end, and applying a outside header to the first crimp and to the second crimp. Self seal adhesive can be used to bond the inside header to the outer wrapper, to bond the outside header to the outer wrapper, or to bond both inside header and the outside header to the outer wrapper.

DETAILED DESCRIPTION OF THE PREFERRED EMBODIMENT

Roll wrap refers to the product used to wrap and protect a roll of paper throughout the distribution process. In general, once a roll of paper is formed, it is desirable to wrap the paper roll sufficiently to protect the paper roll until it is used so that the paper is not damaged. It is often necessary to transport a paper roll from one location to another and thereby expose the paper roll to environmental conditions that could damage the paper. Exemplary environmental conditions that could damage the paper include rain, snow, sleet, wind, dirt, grease, gasses, light, and various fluids. In addition, the paper can be damaged as a result of mechanical impacts on the roll of paper. The roll wrap helps protect the roll of paper.

Roll wrap generally includes at least two components. The first component can be referred to as the outer wrapper and the second component can be referred to as the header. The outer wrapper generally circumscribes or wraps the periphery or circumference of the paper roll along the length of the paper roll. The header is placed on the ends of the paper roll. The outer wrapper can be crimped at the ends so that the crimping extends about the paper roll ends. In general, crimping refers to the folding of the ends of the outer wrapper over the ends of the paper roll. The header can be provided as an inside header, an outside header, or a combination of an inside header and an outside header. The insider header is provided between the paper roll and the crimp at the end of the paper roll with the outer wrapper crimped thereover. The outside header is provided at the end of the paper roll over the crimp.

Figure 1:
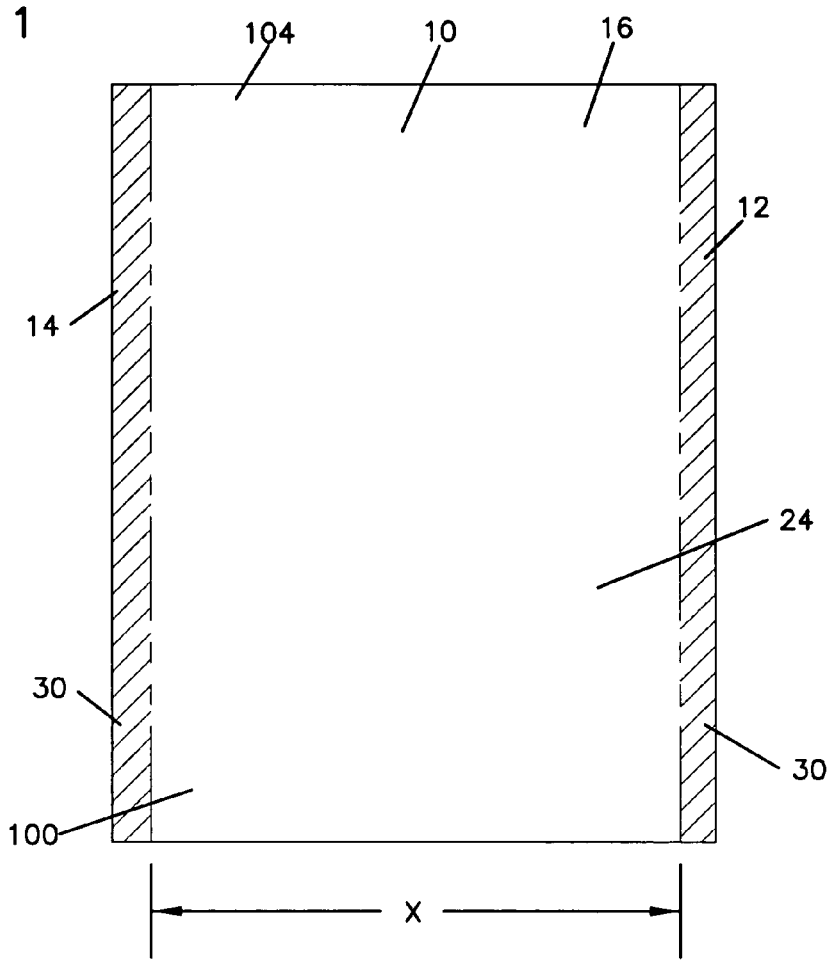
FIG. 1 is a plan view of roll wrap according to the principles of the present invention.
Figure 2:
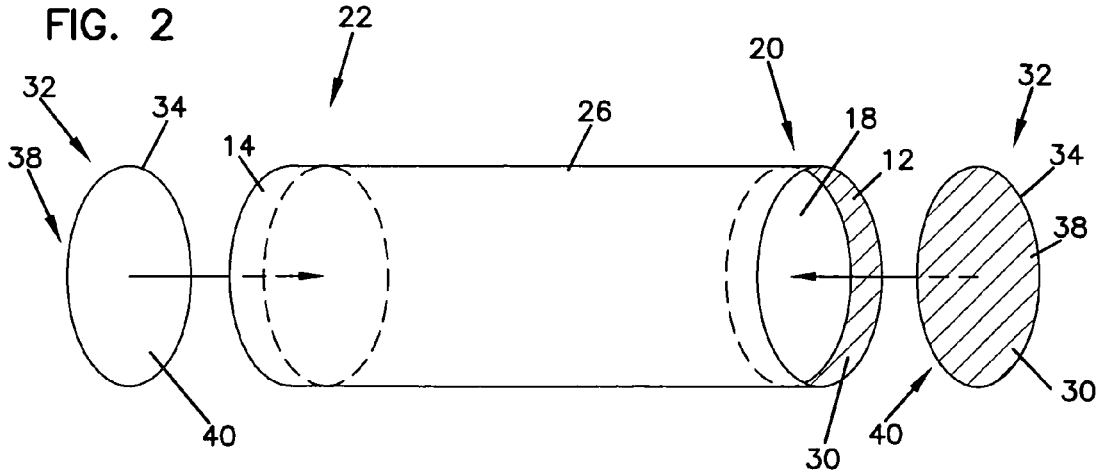
FIG. 2 is a perspective view of a paper roll and the roll wrap of FIG. 1 prior to application of the inside header and prior to crimping of the outer wrapper.
Figure 3:
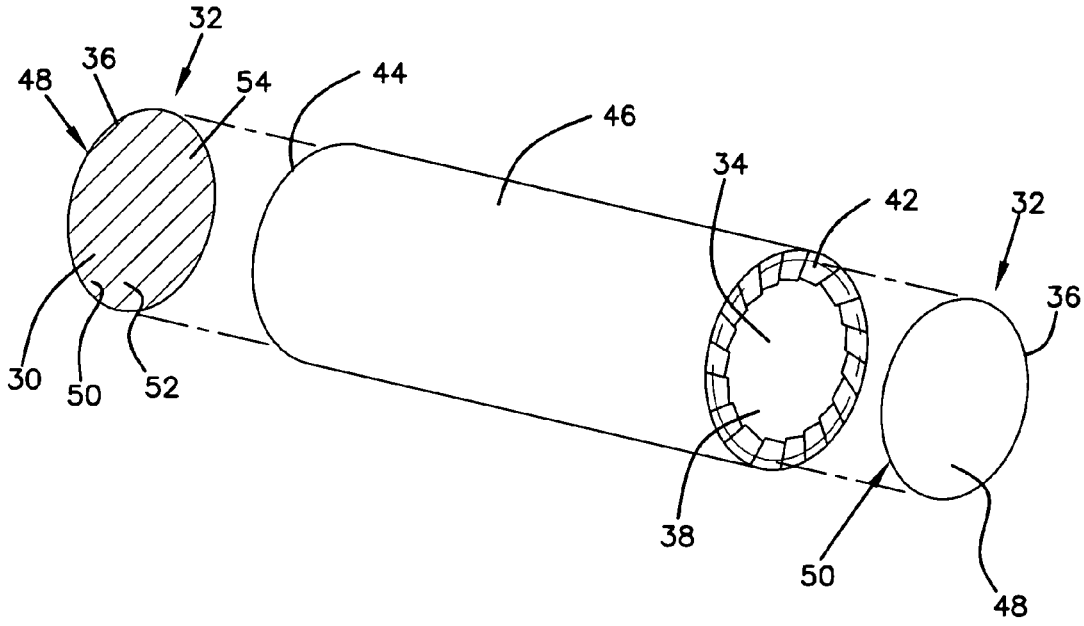
FIG. 3 is a perspective view of the paper roll and the roll wrap shown in FIG. 2 wherein the ends of the outer wrapper have been crimped.
Figure 4:
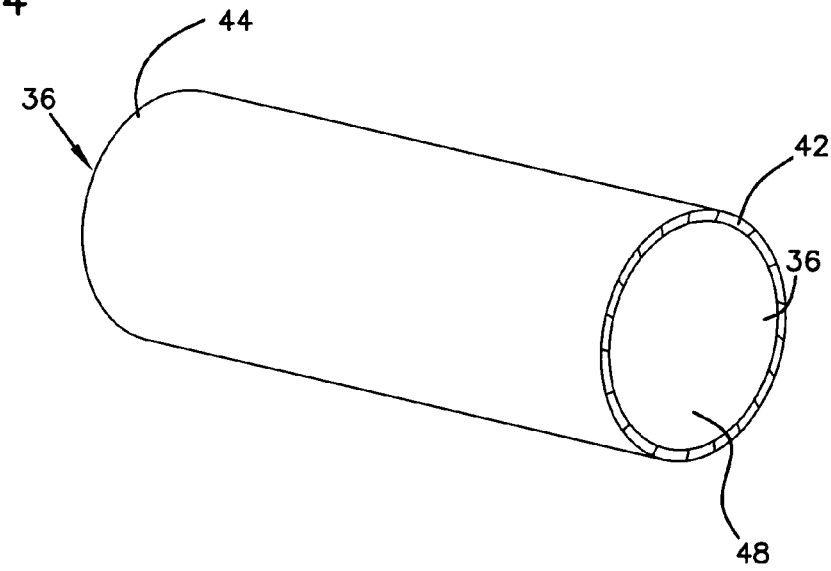
FIG. 4 is a perspective view of the paper roll and roll wrap shown in FIG. 3 after application of the outside headers.

Now referring to FIGS. 1-4, an outer wrapper according to the principles of the present invention is shown at reference number 10. The outer wrapper 10 is sized to wrap a roll of paper having a roll width x. The outer wrapper 10 includes a first edge region 12, a second edge region 14, and a peripheral wrapper portion 16 provided between the first edge region 12 and the second edge region 14. The first edge region 12 and the second edge region 14 are provided to overhang the paper roll that is wrapped using the outer wrapper 10. An exemplary paper roll is shown in FIG. 2 at reference number 18. The first edge region 12 and the second edge region 14 are available for crimping over the paper roll first end 20 and the paper roll second end 22, respectively. The peripheral wrapper portion 16 generally wraps the paper roll 16 about its circumference and along its width x.

The outer wrapper 10 includes an inside surface 24 and an outside surface 26. The first edge region 12 and the second edge region 14 include a self seal adhesive 30 on the inside surface 24. The inside surface 24 refers to the surface that contacts the paper roll 18. The outside surface 26 is the surface that can be exposed to the environment when the outer wrapper 10 is wrapped around the paper roll 18. The self seal adhesive 30 can be provided on the insider surface 24 and provided in a form that allows the outer wrapper 10 to be available in a roll form prior to use without the roll experience blocking. In general, blocking refers to the adhesion of one layer in a roll to another layer that makes unrolling the roll difficult or impossible without damaging the roll. When the outer wrapper 10 is provided in a roll, the self seal adhesive 30 on the inside surface 24 contacts the outside surface 26. The self seal adhesive 30 should be provided in a form so that it does not adhere to the outside surface 26 during conditions expected to be encountered during storage of the roll of outer wrapper 10. By way of example, the self seal adhesive can be provided so that when a roll of the outer wrapper containing the self seal adhesive is in an environment that reaches a temperature of 150° F., the roll does not block.

The portion of the outer wrapper 10 that is available for crimping over the paper roll ends can include the self seal adhesive 30. The self seal adhesive can be characterized as an adhesive that, when provided on a substrate, bonds to the same adhesive or another self seal adhesive provided on another substrate but does not bond to the substrate without a self seal adhesive. A self seal adhesive forming composition can be applied to a substrate and allowed to dry or cure to form a self seal adhesive. As a result, the self seal adhesive bonds to the substrate to which it is applied as a self seal adhesive forming composition. The self seal adhesive, however, does not bond to another substrate not containing a self seal adhesive on that substrate. The self seal adhesive can be available for providing adhesive properties when bonding to another substrate containing a self seal adhesive at room temperature conditions. An advantage of the self seal adhesive is that it is not necessary to heat the adhesive to temperatures normally associate with melting hot melt adhesives or thermoplastic polymers, and it is not necessary to handle liquid or wet adhesives when bonding substrates. It is possible that heating a self seal adhesive to a temperature greater than 200° F. and possible greater than a temperature of 230° F. may enhance bonding of the self seal adhesive to another self seal adhesive. Exemplary self seal adhesives are available under the name Resyn Self Seal from National Starch, Nip-Weld and Turbo Seal from Bostic, and Robond from Rohm & Haas. Exemplary self seal adhesives include Resyn Self Seal 35-051A, Resyn Self Seal 35-6148, Resyn Self Seal 35-6183, Resyn Self Seal 35-013A, Resyn Self Seal 35-032A, Resyn Self Seal 35-039A, Resyn Self Seal 35-041A, Resyn Self Seal 35-6174, Resyn Self Seal 35-6175, Resyn Self Seal 35-6179, Resyn Self Seal 35-6183, Resyn Self Seal 35-6196, Resyn Self Seal 35-051A, Resyn Self Seal 35-6148, and Resyn Self Seal 35-6183. Various Robond adhesives include the CS series 1000, the CS series 2000, the CS series 3000, and the CS series 4000.

A header 32 can be placed on the paper roll first end 20 and second end 22. The header 32 can be provided as an insider header 34, an outside header 36, or a combination of an insider header 34 and an outside header 36. In order for the self seal adhesive 30 on the outer wrapper 10 to be effective in providing a seal, the insider header 34 can include a first surface 38 containing the self seal adhesive 30 and a second surface 40 that may or may not contain the self seal adhesive. Because the inside header second surface 40 faces the paper roll end, it is not necessary for there to be self seal adhesive on that surface. Accordingly, it maybe desirable to provide self seal adhesive 30 on the insider header first surface 38 and not on the inside header second surface 40. To avoid a situation where the inside header 34 is placed on the ends of the roll backward so that the second surface 40 not containing a self seal adhesive faces outward, it may be desirable to provide self seal adhesive 30 on both the inside header first surface 38 and the inside header second surface 40 so that which ever way the inside header 34 is placed on the paper roll ends, there is self seal adhesive 30 on the inside header 34 that is available for bonding with the self seal adhesive 30 on the inside surface 24 of the outer wrapper 10.

As the first edge region 12 and the second edge region 14 are crimped or folded over the paper roll first end 20 and the paper roll second end 22, the outer wrapper 10 bonds to the inside header 34. The first edge region 12, after it is crimped, can be referred as the first crimped end 42. The second edge region 14, after it is crimped can be referred as the second crimped end 44. The resulting wrapped roll 46 can be considered sufficiently finished for transporting and storing the paper roll. If desired, an outside header 36 can be applied to the first crimped end 42 and the second crimped 44. The outside header 36 can include an outside header first surface 48 and an outside header second surface 50. The outside header second surface 50 can include an adhesive 52 or a thermoplastic polymer 54. The adhesive 52 can be a self seal adhesive, a hot melt adhesive, or a liquid adhesive such as an aqueous based adhesive or an organic solvent based adhesive. In general, the hot melt adhesive or the thermoplastic polymer can be heated so that the outside header 36 can be applied to the first crimped end 42 and the second crimped end 44 to provide a seal. Exemplary disclosures of hot melt adhesives for use on an outside header are provided in U.S. Pat. No. 6,505,459, the disclosure which is incorporated herein by reference. Exemplary thermoplastics that can be used for the outside header are disclosed in U.S. Pat. No. 5,090,566 and U.S. Pat. No. 4,820,370, the disclosures which are incorporated herein by reference. Various techniques and equipment are known for heating outside headers so that they can bond to the ends of a roll of paper.

In an alternative embodiment, the outside header 10 can include the self seal adhesive 30 on both the inside surface 24 and the outside surface 26 along the first edge region 12 and the second edge region 14. In this embodiment, the first edge region 12 and the second edge region 14 can bond to the inside header 34 along the inside header first surface 38. Because there is self seal adhesive available on the inside header first surface 38 and on the outside surface 26 along the first edge region 12 and the second edge region 14, the outside header 36 can include an outside header second surface 50 containing a self seal adhesive. As a result, the outside header 36 can be applied over the first crimped end 42 and the second crimped end 44 without the use of hot melt adhesives or thermoplastic polymers that require heating.

In an embodiment where self seal adhesive is placed on both the inside surface and the outside surface of an outer wrapper, it maybe desirable to provide the outer wrapper in a roll with a liner that prevents contact between self seal adhesives.

Figure 5:
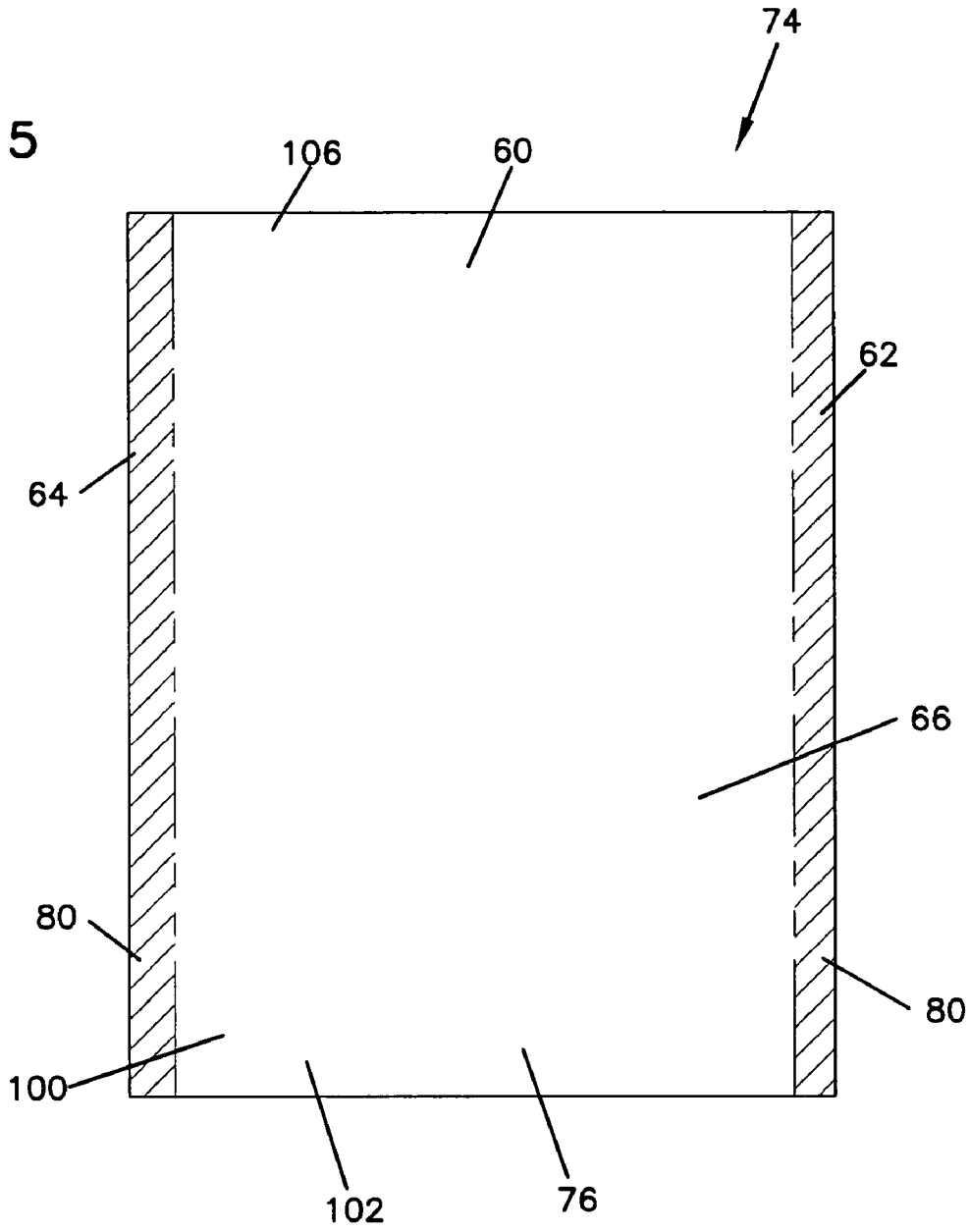
FIG. 5 is a plan view of an alternative roll wrap according to the principles of the present invention.
Figure 6:
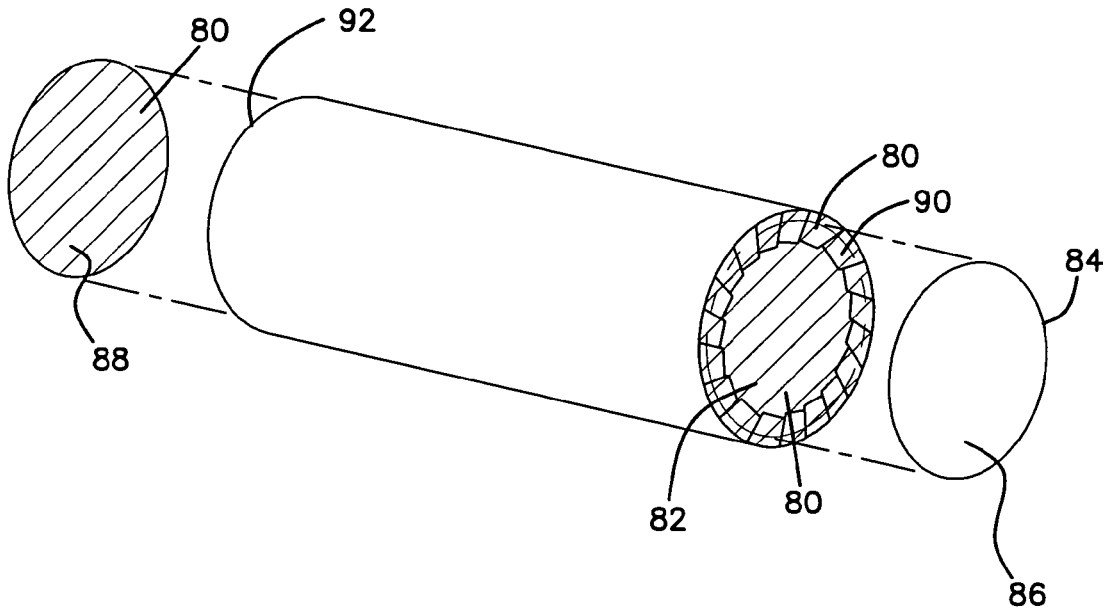
FIG. 6 is a perspective view of a paper roll and the roll wrap shown in FIG. 5 wherein the ends of the outer wrapper have been crimped.

Now referring to FIGS. 5 and 6, an alternative embodiment of the invention is shown. An outer wrapper 60 can be provided having a first edge region 62, a second end region 64, a peripheral wrapper portion 66, an inside surface 74, and an outside surface 76. The self seal adhesive 80 can be provided on the outside surface 76 along the first edge region 62 and the second edge region 64. An inside header 82 can be provided between the end of the paper roll and the crimped first edge region 62 and the crimped edge second edge region 64. In addition, the inside header can be omitted, if desired. When the inside header 82 is provided, it may or may not have a self seal adhesive 80 available for bonding with the outside header 84.

The outside header 84 can be provided having an outside header first surface 86 and an outside header second surface 88. The outside header second surface 88 contains the self seal adhesive 80. Once the outside header 84 is placed over the first crimped end 90 and the second crimped end 92 so that the self seal adhesive on the outside header second surface 88 contacts the self seal adhesive 80 on the first crimped end 90 and the second crimped 92, a seal can be provided. The presence of the self seal adhesive 80 on the inside header 82 can provide an additional seal with the outside header 84.

The self seal adhesive can be applied to the outer wrapper and to the header by various techniques including coating and printing. Furthermore, the self seal adhesive composition can be provided as an aqueous based adhesive and allowed to dry.

Now referring to FIGS. 1-6 the roll wrap can be applied to a roll of paper. The outer wrapper 10 and the outer wrapper 60 include leading edges 100 and 102 and adhesive can be applied to the leading edges 100 and 102 to tack the outer wrapper 10 and 60 to a roll of paper. For example, adhesive can be applied to the inside surface 24 of the leading edge 100, and can be applied to the inside surface 74 of the leading edge 102. It should be understood that the context of the leading edge refers to a general area and not to a specific end. Once the outer wrapper sufficiently wraps the roll of paper, adhesive can be applied to the trailing edges 104 and 106 to cause the trailing edge to adhere to the outer wrapper. The inside header 34 and 82, if desired, can be applied to the ends of the paper roll and the outer wrapper 10 and 60 can be crimped thereover. The outside header 36 and 84, if desired, can then be applied over the crimped ends. The adhesive that can be used for tacking the outer wrapper can be a hot melt adhesive, an aqueous based adhesive, or an organic solvent based adhesive.

The outer wrapper can be formed from a single-ply of paper where the self seal adhesive is applied at the first edge region and the second edge region. Furthermore, the outer wrapper can be provided as a multiple ply (multi-ply) structure (e.g., two or more plies) where the multiple plies extend across the entire width of the outer wrapper and the self seal adhesive can be applied at the first edge region and the second edge region. Alternatively, the outer wrapper can be provided having multiple plies at the peripheral wrapper portion and fewer plies at the first edge region and the second edge region. By fewer plies, it is possible to have a two ply peripheral wrapper portion and a single-ply first edge region and a single-ply second edge region. One way to accomplish this to have a first substrate that is wider than a second substrate, and bonding the two substrates together to provide a multi-ply peripheral wrapper portion and single-ply first edge region and a single-ply second edge region. In addition, it is possible to bond two substrates together in an overlapping arrangement so that one of the substrates forms the single-ply first edge region and the other substrate forms the single-ply second edge region. Such an arrangements can be conveniently provided because of the ease of application of the self seal adhesive forming composition by techniques such as coating and printing. Providing a single ply at the first edge region and the second edge region can be more convenient for crimping compared with crimping a multi-ply structure. In addition, providing a multi-ply structure at the peripheral wrapper portion can help protect the paper roll.

The substrate used to form the outer wrapper and the header can include Kraft paper, liner board, combining Kraft paper, grocery sack paper, and various other forms of paper.

The fibers used to form the paper substrate can be selected to provide the paper substrate with desired properties. One of skill in the art will appreciate that the web of fibers can comprise many different types of fibers, both natural and synthetic. Natural fibers from plants can often be referred to as cellulosic fibers. Exemplary natural fibers that can be used include wood fibers and non-wood natural fibers such as vegetable fibers, cotton, various straws (wheat, rye, and others), various canes (bagasse and kenaf), grasses (bamboo, etc.), hemp, corn stalks, etc. Exemplary synthetic fibers that can be used include polyester fibers, bicomponent fibers, polyethylene fibers, rayon fibers, lyocell fibers, polypropylene fibers, acrylic fibers, and polyvinyl alcohol fibers.

The pulp used for creating the web of fibers can include hardwood fibers, softwood fibers, or a blend of hardwood and softwood fibers. The pulp can be provided as cellulose fiber from chemical pulped wood, and can include a blend from coniferous and deciduous trees. By way of example, the fibers can be from northern hardwood, northern softwood, southern hardwood, or southern softwood. Hardwood fibers tend to be more brittle but are generally more cost effective for use because the yield for pulp from hardwood is higher than the yield for pulp from softwood. The pulp can contain about 0 to about 70% hardwood fibers based on the weight of the fibers. Softwood fibers have desired paper making characteristics but are generally more expensive than hardwood fibers. The pulp can contain about 0 to about 100% softwood fibers based on the weight of the fibers. The pulp can contain a blend of hardwood and softwood fibers.

The natural fibers used in the invention can be extracted with various pulping techniques. For example, mechanical or high yield pulping can be used for stone ground wood, pressurized ground wood, refiner mechanical pulp, and thermomechanical pulp. Chemical pulping can be used incorporating kraft, sulfite, and soda processing. Semi-chemical and chemi-mechanical pulping can also be used which includes combinations of mechanical and chemical processes to produce chemi-thermomechanical pulp.

The fibers can also be bleached or unbleached. One of skill in the art will appreciate that the bleaching can be accomplished through many methods including the use of chlorine, hypochlorite, chlorine dioxide, oxygen, peroxide, ozone, or a caustic extraction.

The pulp can also include post-consumer waste (PCW) fiber. Post-consumer waste fiber is recovered from paper that is recycled after consumer use. Post-consumer waste fiber can include both natural and synthetic fiber. Incorporation of PCW fiber can aid in efficient use of resources and increase the satisfaction of the end user. The pulp can additionally include synthetic fibers. The incorporation of synthetic fibers can aid in strength and absorbency.

Refining is the treatment of pulp fibers to develop their papermaking properties. Refining increases the strength of fiber to fiber bonds by increasing the surface area of the fibers and making the fibers more pliable to conform around each other, which increases the bonding surface area and leads to a denser sheet, with fewer voids. Most strength properties of paper increase with pulp refining, since they rely on fiber to fiber bonding. The tear strength, which depends highly on the strength of the individual fibers, actually decreases with refining. Refining of pulp increases the fibers flexibility and leads to denser paper. This means bulk, opacity, and porosity decrease (densometer values increase) with refining. Fibrillation is a result of refining paper fibers. Fibrillation is the production of rough surfaces on fibers by mechanical and/or chemical action; refiners break the outer layer of fibers, e.g., the primary cell wall, causing the fibrils from the secondary cell wall to protrude from the fiber surfaces.

The fibers can be refined so that the resulting paper (including synthetic fiber) provides the desired Canadian Standard Freeness value. In general, less refined paper has more holes and voids than a more refined paper. To reduce penetration of a coating into the paper substrate, it may be desirable to provide a desired level of refining to reduce the presence of holes and voids.

The basis weight of a paper refers to the weight per unit area of the web of fibers with additives that may be introduced either or both wet end chemistry and size press chemistry, but before the introduction of aqueous polymer dispersion. In general, the basis weight can be selected to provide the paper product having the desired properties for a particular application. In certain applications it may be desirable to provide paper from a heavier basis weight web of fibers compared with another application. Accordingly, a general range for selecting the basis weight of the web of fibers can be about 10 lbs./3000 $ft^2$ to about 300 lbs./3000 $ft^2$, or about 15 lbs./3000 $ft^2$ to about 210 lbs./3000 $ft^2$.

The roll wrap can be used to wrap a paper roll produced as a result of a paper making process. The paper roll can have a wide range of sizes. Many paper rolls that are manufactured and then transported to another location can have a width of about 1 foot to about 11 feet and can have a diameter of about 2 feet to about 6 feet. The length of a roll of paper refers to the running length of the paper as it unrolls.

The above specification provides a complete description of the manufacture and use of the composition of the invention. Since many embodiments of the invention can be made without departing from the spirit and scope of the invention, the invention resides in the claims hereinafter appended.

I claim:

1. A roll wrap for wrapping a paper roll comprising:

(a) an outer wrapper constructed for circumscribing the periphery of the paper roll along a width of the paper roll from a first end of the paper roll to the second end of the paper roll, wherein the outer wrapper comprises a peripheral wrapper portion, a first edge region for forming a first crimp, a second edge region for forming a second crimp, an interior surface for contacting the paper roll, and an exterior surface, wherein at least one of the exterior surface first edge region and the exterior surface second edge region or the interior surface first edge region and the interior surface second edge region comprises a self seal adhesive, wherein the self seal adhesive is an adhesive that bonds to a self seal adhesive but not to a substrate not containing a self seal adhesive; and (b) a header comprising a first surface and a second surface, wherein at least one of the first surface and the second surface comprises the self seal adhesive.

2. A roll wrap according to claim 1, wherein the self seal adhesive comprises an outside header comprises a paper substrate having a basis weight of about 10 lbs./3000 $ft^2$ to about 300 lbs./3000 $ft^2$.

3. A roll wrap according to claim 1, wherein the self seal adhesive provides bonding at a temperature of less than about 150° F.

4. A roll wrap according to claim 1, wherein the peripheral wrapper portion comprises a multi-ply layer of paper, and the first edge region and the second edge region comprise a single-ply layer of paper.

5. A roll wrap according to claim 1, wherein the outer wrapper comprises self seal adhesive on the interior surface first edge region and on the interior surface second edge region.

6. A roll wrap according to claim 5, wherein the header comprises an inside header comprising self seal adhesive.

7. A roll wrap according to claim 6, further comprising an outside header.

8. A roll wrap according to claim 7, wherein the outside header comprises a hot melt adhesive, a thermoplastic polymer, or a liquid adhesive for adhering to the first crimp and the second crimp.

9. A roll wrap according to claim 1, wherein the outer wrapper comprises the self seal adhesive on the exterior surface first edge region and on the exterior surface second region.

10. A roll wrap according to claim 9, wherein header comprises an outside header comprising self seal adhesive, and is constructed to bond to the first crimp and the second crimp.

11. A wrapped paper roll comprising:

(a) a papa roll having a width of about 1 foot to about 11 feet from a first end to a second end;

(b) a roll wrap packaging the paper roll and providing protection to the paper roll from moisture and mechanical impacts, the roll wrap comprising:

(i) an outer wrapper circumscribing the periphery of the paper roll along the width of the paper roll from the first end to the second end, wherein the outer wrapper comprises a peripheral wrapper portion, a first edge region forming a first crimped edge over the first end of the paper roll, a second edge region forming a second crimped edge over the second end of the paper roll, an interior surface for contacting the paper roll, and an exterior surface, wherein at least one of the exterior surface first edge region and the exterior surface second edge region or the interior surface first edge region and the interior surface second edge region comprises a self seal adhesive, wherein the self seal adhesive is an adhesive that bonds to a self seal adhesive but not to a substrate not containing a self seal adhesive; and (ii) a header comprising a first surface and a second surface wherein at least one of the first surface and the second surface comprises the self seal adhesive.

12. A wrapped paper roll according to claim 11, wherein the self seal adhesive provides bonding at a temperature of less than about 150° F.

13. A wrapped paper roll according to claim 11, wherein the outer wrapper comprises self seal adhesive on the interior surface first edge region and on the interior surface second edge region.

14. A wrapped paper roll according to claim 13, wherein the header comprises an inside header comprising self seal adhesive adhering to the outer wrapper.

15. A wrapped paper roll according to claim 14, further comprising an outside header bonded to the inside header and to the outer wrapper.

16. A wrapped paper roll according to claim 11, wherein the outer wrapper comprises a self seal adhesive on the exterior surface first edge region and on the exterior surface second region.

17. A wrapped paper roll according to claim 16, wherein the header comprises an outside header bonded to the first crimp and the second crimp.

* * * * *